United States Patent [19]

Brecy et al.

[11] Patent Number: 4,972,203

[45] Date of Patent: Nov. 20, 1990

[54] DEVICE FOR REINTRODUCING SOLID DEVELOPER PARTICLES SEPARATED FROM A GASEOUS CARRIER FLOW INTO A RESERVOIR THAT IS OPEN TO THE AIR

[75] Inventors: Andre Brecy, Frahier; Philippe Poinsot, Belfort, both of France

[73] Assignee: Bull S. A., Paris, France

[21] Appl. No.: 442,202

[22] Filed: Nov. 28, 1989

[30] Foreign Application Priority Data

Nov. 29, 1988 [FR] France ..... 88 15596

[51] Int. Cl.[5] ..... G03G 19/00; G03G 15/08

[52] U.S. Cl. ..... 346/74.2; 355/256; 346/160.1

[58] Field of Search ..... 355/206, 207, 297, 298, 355/299, 256, 258, 290, 301, 303, 305, 314, 326; 346/74.2, 74.3, 160.1, 153.1

[56] References Cited

U.S. PATENT DOCUMENTS

| | | | |
|---|---|---|---|
| 4,046,682 | 9/1977 | Hudson | 209/250 |
| 4,246,588 | 1/1981 | Binder | 346/74.3 |
| 4,377,334 | 3/1983 | Nishikawa | 118/658 |
| 4,634,252 | 1/1987 | Jeremijevic | 355/256 X |
| 4,724,459 | 2/1988 | Ford | 355/326 |
| 4,752,805 | 6/1988 | Fukae et al. | 355/298 |

FOREIGN PATENT DOCUMENTS

| | | |
|---|---|---|
| 0086683 | 8/1983 | European Pat. Off. . |
| 1772826 | 9/1975 | Fed. Rep. of Germany . |

OTHER PUBLICATIONS

Japan Patent Abstract Kokai No. 53-3240.

*Primary Examiner*—Donald A. Griffin

*Attorney, Agent, or Firm*—Kerkam, Stowell, Kondracki & Clarke

[57] ABSTRACT

The invention relates to a device for the reintroduction of solid developer particles, which have been separated from a gaseous carrier flow, into a reservoir that is open to the air. The derive (60) is disposed between the reservoir (15) and the apparatus (26) for separation and recovery of particles, and it includes a chute (61) into which the discharge conduit (47) of the apparatus discharges. A transport element (65) that slides inside the chute (61) isolates the discharge conduit from ambient atmospheric pressure. This transport element is provided with a cavity (67) in which the particles that drop into the conduit accumulate, and the accumulated particles are then transported outside the chute and drop into the reservoir (15). The invention is applicable to non-impact printing machines.

28 Claims, 7 Drawing Sheets

DEVICE FOR REINTRODUCING SOLID DEVELOPER PARTICLES SEPARATED FROM A GASEOUS CARRIER FLOW INTO A RESERVOIR THAT IS OPEN TO THE AIR

CROSS REFERENCE TO RELATED APPLICATION

This application is related to U.S. application Ser. No. 442,201, filed Nov. 28, 1989, and assigned to the same assignee as the present invention.

FIELD OF THE INVENTION

The present invention relates to a device for the reintroduction of solid developer particles, which have been separated from a gaseous carrier flow, into a reservoir that is open to the air. More particularly, but not exclusively, such a device is used in non-impact printing machines, in which developer particles, after having been deposited to excess on the recording carrier with which these machines are equipped, are removed from the carrier surface with a suction device and are collected in a recovery box for recycling.

BACKGROUND OF THE INVENTION

Non-impact printers used in information processing equipment are well known at present. These machines include a recording carrier, most often comprising a rotary drum or an endless belt, on the surface of which sensitized zones, also known as latent images, can be formed electrostatically or magnetically, corresponding to the characters or images to be printed. These latent images are then developed, or in other words made visible, with the aid of a powdered developer, which when deposited on the recording carrier is attracted only by the sensitized zones on it, thus forming an image in powder on the surface of the carrier. Next, the recording carrier is put in contact with a sheet of paper, so that the developer particles comprising the powdered image can be transferred to the sheets and definitively fixed there.

The application of developer particles to the recording carrier in printing machines of this type is accomplished by applicator devices of a known type, such as that described in U.S. Pat. No. 4,246,588 (corresponding to French Patent No. 2.408.462). These applicators generally include a transport means that as it travels past an opening in the upper portion of the reservoir containing the particles picks up particles located in the reservoir and moves them to the vicinity of the surface of the recording carrier. With these applicators, however, despite all the care taken in their construction, it is difficult to prevent the developer particles from being deposited not only to excess over the sensitized zones of the recording carrier but also, although in very small amounts, outside these zones. For this reason the printers are also provided with a retouching device, which is disposed between the particle applicator and the station where the particles are transferred to a sheet of paper and makes it possible to remove the excess developer particles located on the surface of the recording carrier. Although retouching devices capable of performing the retouching by magnetic attraction or by blowing air have been made, the preference at present is for retouching devices that function by air suction and have the advantage of being non-polluting and of enabling removal of the excess particles on the recording carrier surface, without requiring that the particles have magnetic properties in order to accomplish this. Furthermore, some of these retouching devices are associated with transport devices that enable the developer particles, thus removed, to return to the particle reservoir for recycling. Hence a retouching device has been embodied as described in U.S. Pat. No. 4,046,682, which includes both a suction conduit provided with a slit or nozzle, extending in proximity with the surface of the recording carrier, and an opening connected via a duct to a suction turbine. This device also includes an endless belt, made of a material permeable to air, which is driven continuously and passes through the duct. Under these conditions, when the turbine rotates, the excess developer particles on the portions of the recording carrier located vertically of the slit in the suction conduit are transported by the air aspirated by the turbine and as they circulate in the duct are stopped in their passage by the endless belt. The particles are virtually all trapped in the meshes of the material comprising the belt and are then carried by it. In the course of its path, this belt travels under the reservoir holding the particles; when pressed against the edge of a scraper disposed in the upper portion of the reservoir the belt causes the particles with which it is impregnated to drop into the reservoir. However, this procedure, which enables developer particles from the retouching operation to be reintroduced into the reservoir, does not give complete satisfaction; not only is it impractical and always incomplete to recover the particles trapped by the belt, but the portion of the conduit located between the belt and the suction nozzle becomes more or less plugged eventually, which notably lessens the output of the suction turbine. Furthermore, the belt wears very rapidly and must be frequently replaced, with difficulty, which means a higher maintenance cost for the machine in which the belt is used.

The present applicant has recently succeeded in overcoming the problem of separation and recovery of particles by replacing the endless belt with a negative-pressure separator apparatus of a known type, typically known as a cyclone, this apparatus (an improved version of which is the subject of a patent application filed on the same date as the present one by the present applicant) includes a separation chamber provided in its lower portion with a discharge conduit, which is normally closed on its lower end by a movable valve in order to comprise a box in which the particles that have been removed from the gaseous carrier flow accumulate. However, it has been observed that when this apparatus is disposed above the reservoir of particles, each time the valve is opened to allow the recovered particles to drop into the reservoir, a rush of air ensues, because on the one hand the reservoir is necessarily provided with an opening that, since it is intended for the passage of the particle applicator device has the effect of connecting this reservoir with the open air, and on the other hand the separation chamber is at negative pressure with respect to the ambient atmospheric pressure, the value of this negative pressure being on the order of 200 hectopascals. This rush of air not only interferes with the functioning of the cyclone but also entrains particles contained in the reservoir, so that they rise into the separation chamber again. These particles are then aspirated by the air that leaves the separation chamber normally, and being thus entrained they pass through the turbine and are then ejected into the atmosphere, which is not only polluting but in the long term fouls the turbine.

OBJECT AND SUMMARY OF THE INVENTION

The present invention overcomes these disadvantages and proposes a device with which, when it is associated in a suctiontype retoucher with a negative pressure separator apparatus such as a cyclone capable of assuring the separation and recovery of particles carried by a gaseous flow, the thus-recovered particles can be reintroduced into a reservoir open to the air, without causing particles in the reservoir to be entrained into the separator apparatus.

More precisely, the present invention relates to a device for reintroducing solid developer particles, separated from a gaseous carrier flow with the aid of a negative pressure separator apparatus, into a reservoir open to the air, the separator apparatus including a separation chamber provided in its lower portion with a discharge conduit, the device being characterized in that it comprises:

a chute passing in front of and beneath the discharge conduit and provided with an opening enabling the conduit to discharge into this chute;

a transport element arranged to slide inside the chute while quasi-isolating the discharge conduit with respect to ambient atmospheric pressure, the transport element being provided with at least one cavity, which when the transport element is put in a position of repose is located facing the lower end of the discharge conduit and enables the developer particles that drop into the conduit to accumulate in the cavity;

and a drive means arranged to drive the transport element along a predetermined path enabling the cavity to be put in an evacuation location, above the reservoir, in order to allow the particles that have accumulated in the cavity to drop into the reservoir, and then to move thr transport element into a position of repose.

The invention will be better understood and further objects and advantages thereof will become more apparent from the ensuing description given as a nonlimiting example, taken in conjunction with the accompanying drawings.

DESCRIPTION OF THE PREFERRED EMBODIMENTS

Figure 1:
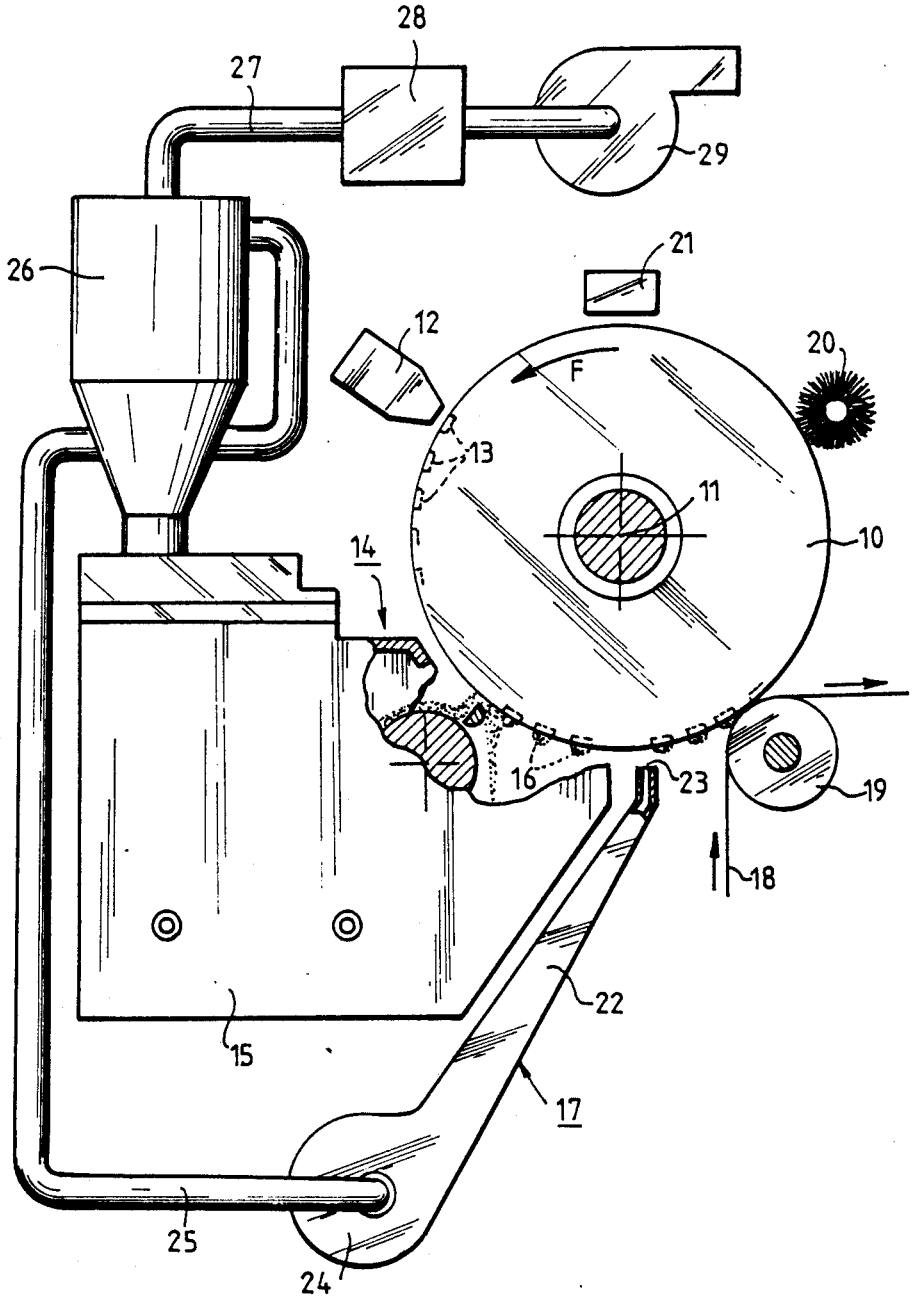
FIG. 1 is a fragmentary schematic view of a magnetographic printing machine provided with a pneumatic retouching device associated with a device for the reintroduction of developer particles according to the invention.

The printing machine schematically shown in FIG. 1 includes a recording carrier, which in the example described comprises a magnetic drum 10. The drum is mounted so that it can rotate about a horizontal shaft 11. An electric motor (not shown) assures the rotation of the drum in the direction indicated by the arrow F. Information is recorded on the drum by a magnetic recording device 12 including a plurality of heads disposed side by side and aligned parallel to the axis of rotation 11 of the drum. Each of the heads, each time it is excited for a brief instant by an electric current, generates a variable magnetic field, the effect of which is to create practically point-shaped magnetized zones 13 on the surface of the drum that moves past the recording device 12; the set of these zones comprises a latent magnetic image corresponding to an image to be printed. The magnetized zones 13 then travel past an applicator device 14 which is disposed practically under the drum 10 and makes it possible to apply particles of a powdered developer contained in a reservoir 15 to the surface of the drum. The developer particles thus applied to the drum 10 adhere in principle only to the magnetized zones on it, such that the magnetized zones that have traveled past the applicator device 14 are coated with a layer of developer, and this layer forms the image on the drum 10 of the characters that are to be printed. In the example described, the developer comprises particles of resin containing magnetic particles; the resin particles have a size on the order of one-twentieth of a micron and the resin is capable of melting when subject to thermal radiation and thus being affixed to paper onto which it has been deposited. Any standard applicator device may be used to apply developer to the drum 10. In a highly advantageous embodiment, however, the applicator device 14 shown in FIG. 1 is of the type described and shown in the aforementioned U.S. Pat. No. 4,246,588.

The developer, which adheres principally to the magnetized zones 13, then forms deposits 16 of particles on the surface of the drum 10. These deposits 16 then pass before a retouching device 17, the role of which is to eliminate the particles that have adhered anywhere but on the magnetized zones 13, as well as particles located in excess on the zones. The developer particles that remain on the drum 10 afterward are transferred virtually totally to a sheet of paper 18 which is pressed against the drum 10 by a pressure roller 19. The residual particles of developer are still located on the drum 10 once this transfer has been made are then lifted by means of a cleaning device 20 of a known type, such as a brush. After that, the magnetized zones that have traveled past the cleaning device 20 travel past an erasing device 21, where they are then erased, which enables the portions of the drum 10 that have thus been demagnetized to be capable of being remagnetized when they again move past the recording device 11.

The retouching device 17 shown in FIG. 1 is of a known type. Without entering into all the details of the structure of this device, it can be noted that the retouching device includes a suction nozzle or conduit 22 practically in the form of a right prism and having a air admission slit 23 at one of its ends that extends in proximity with the surface of the drum 10 along a direction parallel to the axis of rotation 11 of the drum. At its other end the suction conduit 22 communicates with a cylindrical chamber 24 disposed such that the generatrices of the chamber extend parallel to the direction of elongation of the air admission slit 23. One of two circular walls of this chamber is provided with a suction opening having a duct 25, which enables the chamber 24 to be connected to an apparatus 26 for separation and recovery of particles to be described hereinafter. Via another duct 27 provided with a filtering element 28, this apparatus 26 is in turn connected, to a suction turbine 29. It will now be understood that when the turbine 29 is started up, a partial vacuum is created inside the pneumatic device comprising the retouching device 17, the duct 25, the separation and recovery apparatus 26, the duct 27, the filter element 28 and the turbine 29. Consequently the developer particles that have been deposited to excess on the surface of the drum 10 are entrained, when they travel past the slits 23 of the suction conduit 22, by the air that has aspirated through this slit. This air, thus laden with developer particles, then form a flow of air that circulates in succession in the suction conduit 22, the chamber 24 and the duct 25. This air is relieved of its particles when it passes through the apparatus 26, and then, having practically been purified when it leaves this apparatus, circulates in the duct 27 before passing through the filter element 28 and finally being returned to the atmosphere via the turbine 29.

The apparatus 26, which makes it possible not only to separate the developer particles that have been transported by the air flow circulating in the pneumatic device but also to recover practically all the particles, without a possibility of re-aspiration of the particles by this air flow, preferably comprises a scrubber apparatus of a known type, typically known as a cyclone. This apparatus, which is shown in section in FIG. 2, includes a separation chamber 40, comprising an upper portion 41 of cylindrical shape and a lower portion 42 of conical shape. The chamber 40 is provided in its upper portion with a horizontal admission conduit 43, on the one hand, connected to the duct 25 via which the air laden with developer particles arrives; the admission conduit is disposed at a tangent to the cylindrical wall of the portion 41 in such a manner as to create a turbulent flux on the interior of the chamber for the air that arrives in this chamber via this conduit. On the other hand, the chamber 40 is provided with an escape conduit 44 of cylindrical shape, which is disposed along the vertical axis 45 of the chamber 40 and extends to the interior of the cylindrical portion 41 of this chamber, to permit the evacuation of the air which has been relieved of its particles in this chamber. The escape conduit 44 is connected to the duct 27 connecting the apparatus 26 to the suction turbine 29. In its lower portion, the separation chamber 40 is also provided with an outlet opening 46 that communicates with a discharge conduit 47 of cylindrical shape.

The turbulence created by the air flow arriving in the chamber 40 via the admission conduit 43 rotates rapidly inside this chamber. Centrifugal force causes the developer particles, the specific mass of which is higher than that of air, to separate from the air flow and form a turbulent layer that comes into contact with the cylindrical wall of the portion 41 of the chamber. However, these particles are also subject to the force of gravity, so that while continuing to rotate, they finally descend in the portion 42 of the chamber and engage the discharge conduit 47. To permit the particles thus collected by the discharge conduit to be reintroduced into the reservoir 15, the separation and recovery apparatus 26 is associated with a particle reintroduction device that will now be described.

Figure 2:
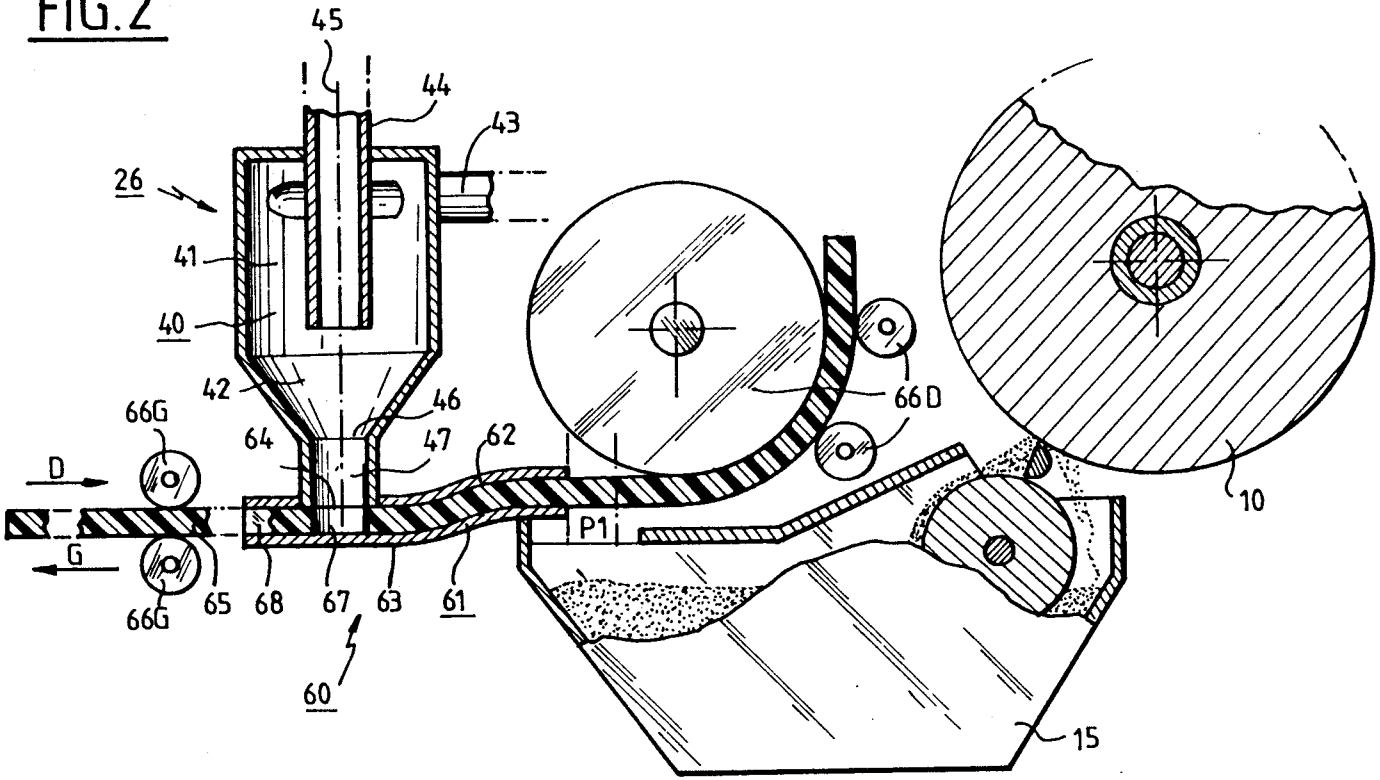
FIG. 2 is a sectional view showing the general principle of the device enabling the reintroduction of particles into a reservoir open the air.

In its general embodiment shown in FIG. 2, the reintroduction device, identified by reference numeral 60, includes two plates 62 and 63 disposed parallel to one another; the plate 63 is located under the plate 62. These two plates are joined together by means of two lateral vertical plates 68, only one of which is visible in FIG. 2; the two plates 68 are fixed to the opposite parallel edges of the plates 62 and 63, in such a way that the set of these four plates forms a chute of constant rectangular section, identified by reference numeral 61 in FIG. 2. The upper plate 62 is pierced with an opening that enables the discharge conduit 64 to discharge into the chute 61, yet without projecting into the interior of the chute. As a result, the lower plate 63 passes beneath and in proximity to the end 64 of this conduit 47. The chute 61 extends between two ends, one of which is near the discharge conduit 47 and the other of which is located above the particle reservoir 15. It should be noted that since the lower end 64 of the discharge conduit is not necessarily located at the same level as the upper portion of the reservoir 15, the chute 61 may include oblique portions, as can be seen in FIG. 2. Nevertheless, the portions of the chute that are located vertically of the discharge conduit 47 and of the reservoir 15 are disposed horizontally.

The reintroduction device 60 shown in FIG. 2 also includes a transport element, in the example described comprising a movable flexible belt 65, arranged so that it can slide easily inside the chute 61, while preventing the communication of the discharge conduit 47 with the ambient atmoshpere via this chute. Thus in the example described, this belt 65, the dimensions of which are such that it can slide inside the chute 61 with as little play as possible, is made of a flexible material that is not permeable to air, such as the polychloroprene material sold commercially under the name Neoprene (registered trademark). Under these conditions, by regulating the operation of the turbine 29 in a known manner, the negative pressure inside the separation chamber 40 can be adjusted to a constant value, which makes it possible to assure effective separation of the developer particles that have been transported by the air flow circulating inside the pneumatic device discussed above. It should be noted here that the air pressure inside the chamber 40 is kept at a fixed value $P_1$, which is naturally lower than the value $P_0$ of the ambient atmospheric pressure and which is higher, the smaller the size of the particles. In the example described, where the particles have a diameter on the order of 20 $\mu$m, this value $P_1$ is accordingly between 760 and 900 hectopascals. In other words, the depression $\Delta p = p0 - p1$ inside the chamber 40 is kept at a fixed value, which in the example described is substantially between 255 and 115 hectopascals.

It can also be noted that in the embodiment shown in FIG. 2, the belt 65 has two distinct ends and can be driven in displacement either in the direction represented by the arrow D, by drive rollers 66D, or in the reverse direction indicated by the arrow G by drive rollers 66G; the rollers 66D and 66G are disposed on the right and left of the chute 61, respectively, as shown in the drawing. All the rollers are placed against the two sides of the belt 65 to permit it to be kept constantly taut between the rollers. Nevertheless, it should be pointed out that in another embodiment the belt 65 could quite easily be an endless belt driven for displacement in only one direction, for example the direction indicated by the arrow D. FIG. 2 also shows that the belt 65 is provided with cavity 67 extending through the full thickness of the belt 65; the interior volume of the cavity has the form of a straight cylinder with a circular base, the diameter of which is substantially equal to the inside diameter of the discharge conduit 47. In FIG. 2, the belt 65 is shown in the position of repose. In this position, the cavity 67 is located precisely facing the lower end 64 of the discharge conduit 64 and is closed in its lower portion by the lower plate 63 of the chute 61. As a result, the developer particles that after being separated from the carrier air flow in the separation chamber 40 are collected by the conduit 47 can drop into the cavity 67 and collect on the portion of the plate 63 that comprises the bottom of the cavity. The drive rollers 66D and 66G of the belt 65 are controlled by a delay device of a known type (not shown) arranged to trip the drive of the belt 65 at predetermined instants, first in the direction of the arrow D and then in the reverse direction, these instants being selected such that the displacement of the belt 65 in the direction D is tripped slightly before the top of the heap of developer particles that have accumulated in the cavity 67 reaches the level of the lower end of the discharge conduit 47. Thus each time the belt 65 is displaced, the drive rollers 66G are released and made idle, and the belt 65, driven by the rollers 66D, is displaced in the direction D. This displacement continues until the instant when the cavity 67 leaves the chute 61 and arrives at a location Pl, shown in dot-dash lines in FIG. 2, which is contiguous with the end of the chute 61 located above the particle reservoir 15. At that instant, the particles that have so far accumulated in the cavity 67 are no longer retained by the lower plate 63 of the chute 61 and drop into the reservoir 15. As soon as the cavity 67 has reached the location Pl, the rollers 66D are idled, and the belt 65 is driven by the rollers 66G and is displaced in the direction G. This displacement continues until the instant when the cavity 67 is in its position of repose again, facing the conduit 47.

It should be noted that the length of the belt 65 is such that the belt remains in constant contact with the rollers 66D and 66G, both when it is driven in the direction D to enable displacement of the cavity 67 from its position of repose to the location Pl and when it is driven in the opposite direction to enable moving this cavity to its position of repose. Furthermore, the two plates 62 and 63 of the chute 61 extend about the lower end 64 of the discharge conduit over a distance greater than the diameter of the cavity 67. Under these conditions, when the cavity 67 is in communication with the discharge conduit 47, the cavity is in no danger of being made to communicate with the atmosphere at the same time, a condition that would certainly pertain, in the absence of this precaution, if the belt 65 driven in the direction of the arrow G were to move slightly past its position of repose. Since the belt 65 moreover slides with slight play inside the chute 61 and practically prevents the outer air from passing through the chute, the discharge conduit 47 can therefore never be put into direct communication with the atmosphere. As a result, the functioning of the apparatus 26 cannot be interfered with by the air current that would be created if the cavity 67 were put into communication with both the ambient atmosphere and the discharge conduit 47 simultaneously, or if the belt 65 did not assure sufficient tightness of the chute 61 with respect to the ambient atmosphere.

It should be noted again that during the periods of time when the cavity 67 is not longer facing the discharge conduit 47, the developer particles collected by that conduit accumulate in the portions of the upper face of the belt 65 that are located vertically of the conduit. However, since these time periods are always very brief, the amount of particles that accumulate is never very great, and so there is no risk that the particles will reach a high enough level to allow them to be re-aspirated into the air escaping via the escape conduit 44. Under these conditions, when the cavity 67 returns to the position of repose, all these particles drop into the cavity in order to be carried away later and then returned into the particle reservoir 15.

Figure 3:
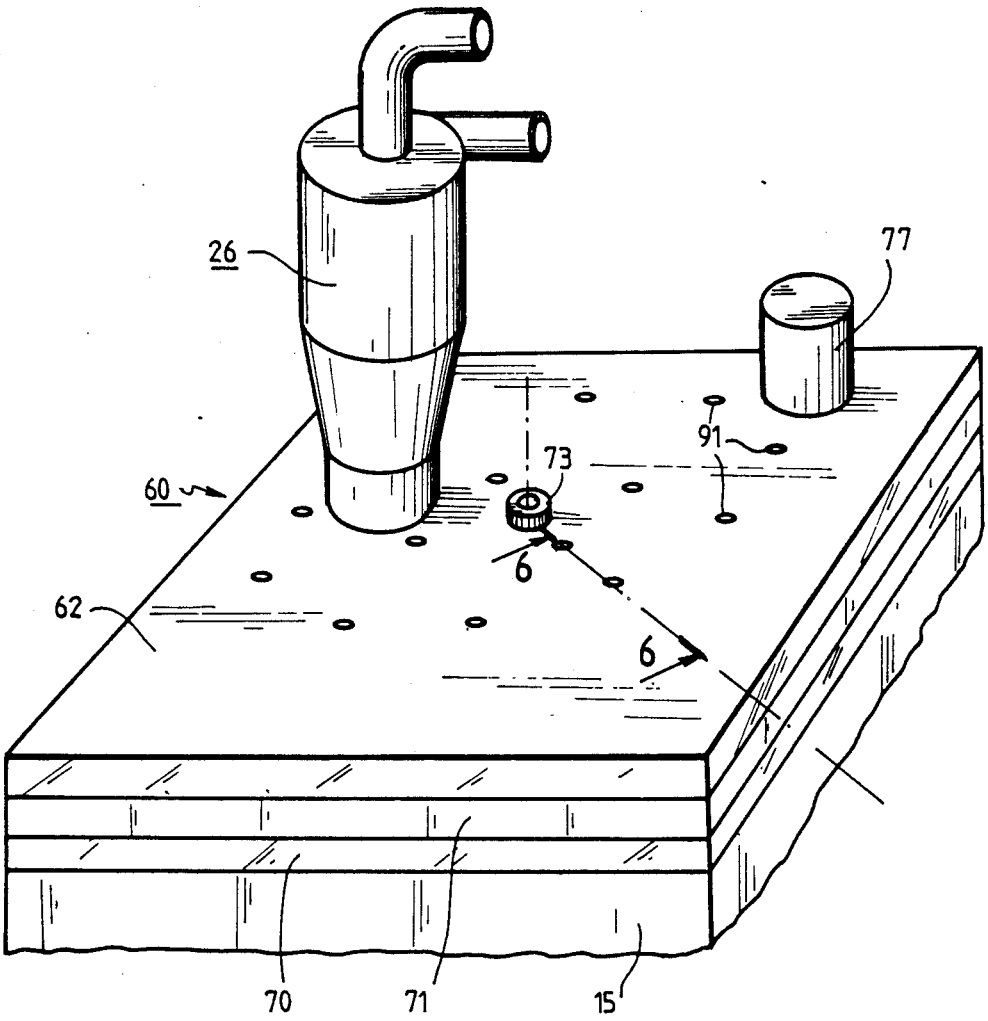
FIG. 3 is a perspective view showing a preferred embodiment of the reintroduction device with which the machine shown in FIG. 1 is equipped.
Figure 4:
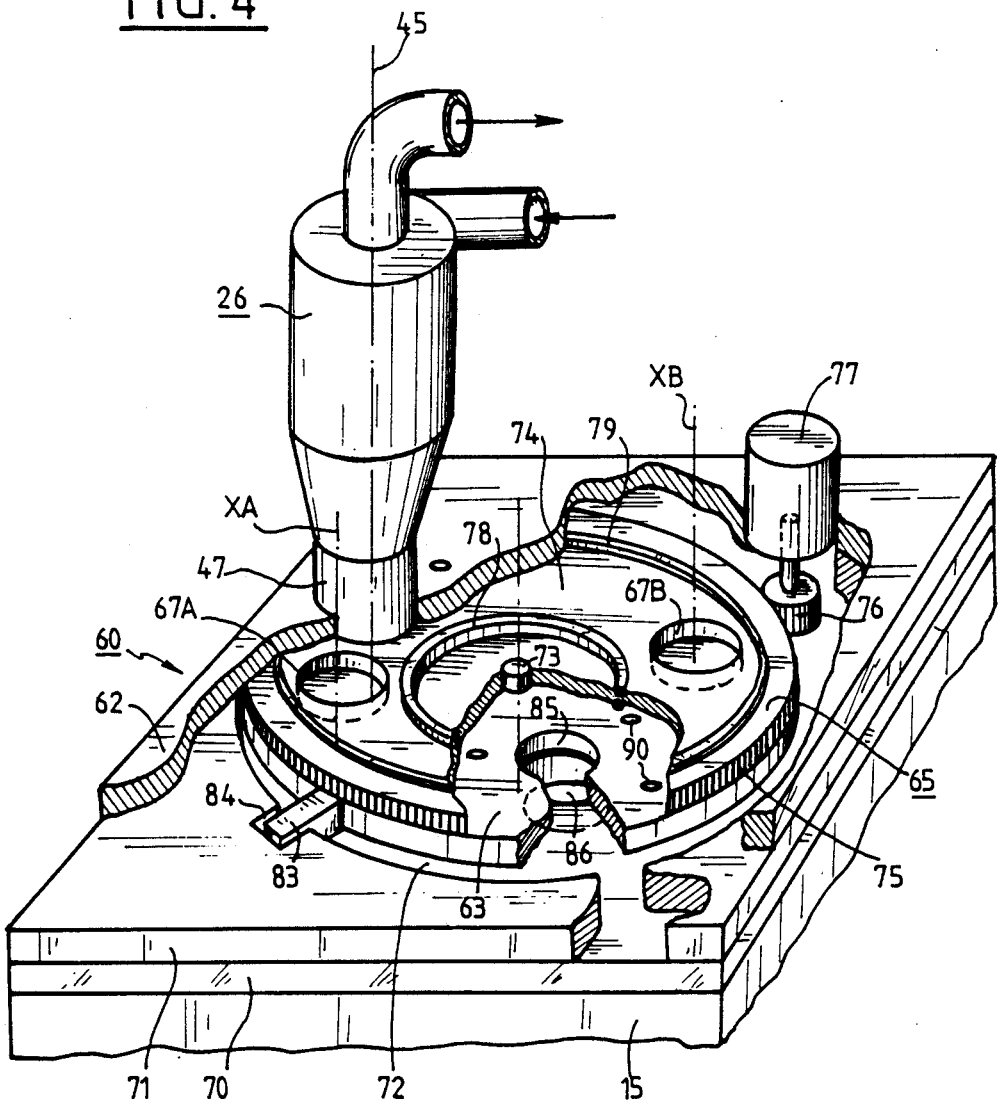
FIG. 4 is a perspective view, with cutaway portions, showing certain details of embodiment of the reintroduction device of FIG. 3.
Figure 5:
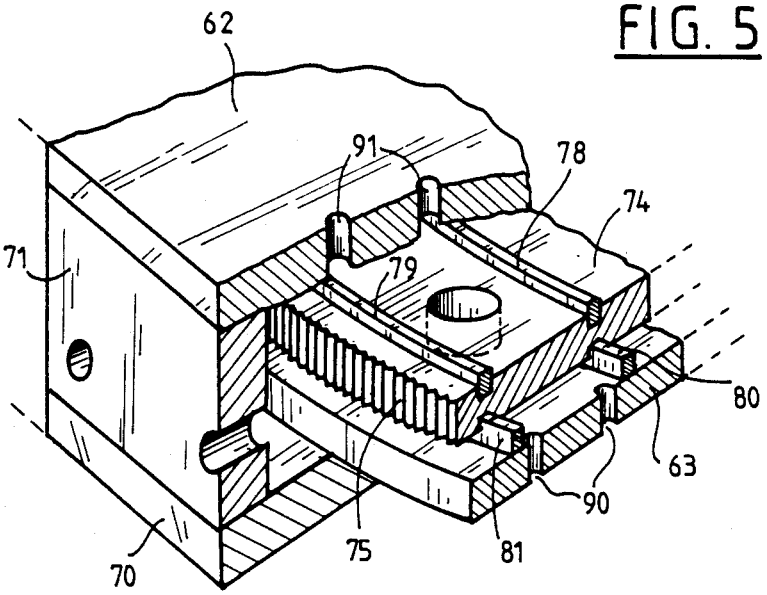
FIG. 5 is a detailed portion of the reintroduction device shown in FIGS. 3 and 4.
Figure 6:
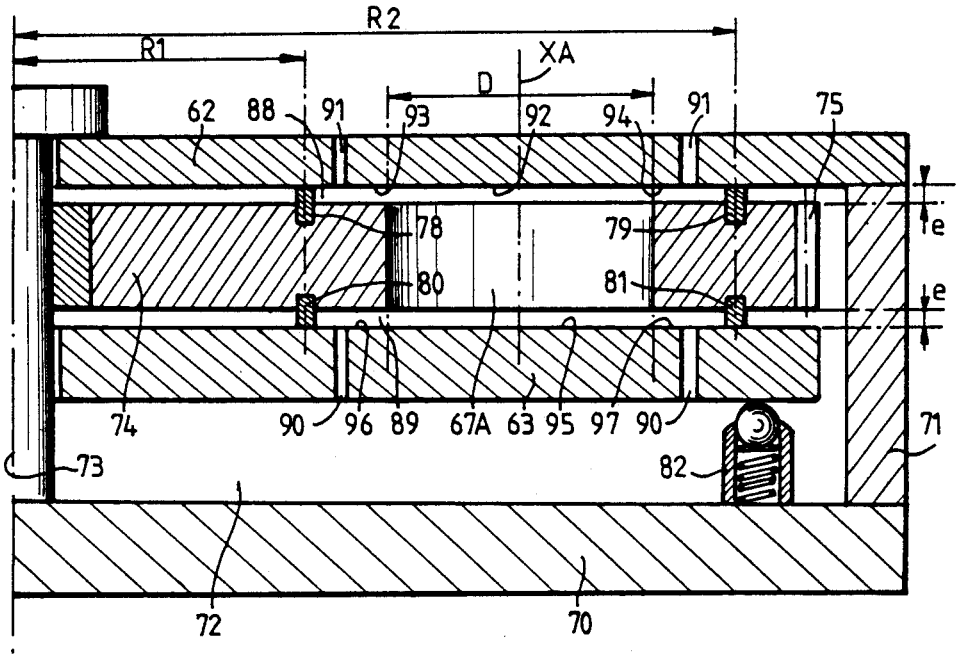
FIG. 6 is a sectional view, taken along a plane indicated by the number 6.6 in FIG. 3, of a portion of the reintroduction device shown in FIGS. 3 and 4.

The device 60 that enables the particles collected by the conduit 47 to be reintroduced into the reservoir 15 may be in some different form from what is shown in FIG. 2. In a particularly advantageous embodiment of the invention, shown in FIGS. 3 and 4, the reintroduction device 60 includes a horizontal pedestal 70 that is affixed to the particle reservoir 15, in the upper portion thereof, and is topped with an intermediate plate 71 provided with a central circular opening 71 that in turn is covered with an upper horizontal plate 61 that entirely covers the opening 72. The set formed by the pedestal 70 and the plates 71 and 62 assembled in this way defines a chamber of cylindrical shape in which the other constituent parts of the reintroduction device are disposed. Disposed in the center of this chamber is a vertical shaft 73, about which a rigid horizontal disk 74 can pivot; the disk 74 is provided with teeth 75 on its periphery that mesh with the teeth of a toothed pinion 76 that is integrally connected to the drive shaft of an electric motor 77 affixed to the upper face of the plate 62. As FIGS. 4, 5 and 6 show, the disk 74 is provided with two elastic sealing rings 78 and 79 accommodated in two concentric circular grooves made in the upper face of this disk, as well as two other elastic sealing rings 80 and 81 accommodated in two concentric circular grooves made in the lower face of the disk; these four grooves admit, as their axis, the pivot shaft 73 of the disk. The two seals 78 and 80 have the same radius, which is equal to a first value Rl. The seals 79 and 81 similarly have the same radius, which equals a second value R2 greater than Rl; the radii Rl and R2 are markedly shorter than the radius of the disk 74. The disk 74, which is mounted on the shaft 73, is supported by a circular horizontal plate 63, which in turn is supported by spring elements, such as the spring 82 shown in FIG. 6, which are affixed to the upper face of the pedestal 70 and urge the plate 63 and the disk 74 upward, or in other words in the direction of the plate 62. Nevertheless, this action does not permit the disk 74 to come into contact with the two plates 62 and 63, because as FIG. 6 shows the seals 78, 79, 80 and 81 protrude from the faces of the disk 74 on which they are placed and leave a small spacing open, the value e of which which be described in detail below, between the opposed faces of the disk 74 and upper plate 62, on the one hand, and the opposed faces of the disk 74 and the lower plate 63, on the other. It should also be pointed out that as can be seen in FIG. 6, the four seals 78, 79, 80 and 81 each have a relatively small cross section, such that the surfaces of the seals that are in contact with the lower face of the plate 62 and with the upper face of the plate 63 are sufficiently small in area that they do not engender major frictional forces when the disk 74 rotates about its shaft 73. The set formed by the disk 74 and the four seals 78, 79, 80 and 81 thus comprises a transport element, designated overall in FIG. 4 by reference numeral 65.

As FIG. 4 shows, the lower plate 63 includes a retaining prong 83, which engages a notch 84 in the lower plate 71 and prevents the plate 63 from rotating about the shaft 73 when the disk 74 is driven in rotation by the motor 77. FIG. 4 also shows that the disk 74 is provided with two cavities 67A and 67B, which are made in the annular zone of the disk included between the two seals 78 and 79 and each of which passes through the full thickness of the disk, as FIG. 6 shows. The interior volume of each of these cavities takes the form of a straight cylinder with a circular base, the axes of the cylinders comprising the cavities 67A and 67B being designated as XA and XB, respectively, in FIG. 4. Furthermore, these two cavities 67A and 67B, which have the same diameter, are disposed such that their respective axes XA and XB, which are parallel to the pivot shaft 73 of the disk 74, are located at the same distance from this pivot shaft. It should also be noted that the apparatus 26 that assures the separation of the developer particles entrained by the air flow is located above the plate 62, such that the vertical axis 45 of the separation chamber and of the discharge conduit of this apparatus are spaced apart from the pivot shaft 73 by a distance equal to the distance separating the shaft 73 and either of the axes XA and XB; the upper plate 62 is pierced with an opening for the passage through it of the discharge conduit. Under these conditions, when the disk 74 is driven to rotate by the motor 77, the cavities 67A and 67B describe the same circular trajectory about the shaft 73, and in the course of their movement they travel successively past the lower end of the discharge conduit 47. At each revolution of the disk 74, these cavities also travel past two openings 85 and 86 located one above the other and made in the lower plate 63 and in the pedestal 70, respectively. These two openings enables the cavity that travels above them to be put into communication with the interior of the particle reservoir 15. It will thus be understood that when one of these cavities is facing the lower end of the discharge conduit 47, the developer particles that after separation from the entraining air flow are collected by this conduit can drop into this cavity and accumulate there on the portion of the plate 63 that comprises the bottom of the cavity. The effect of the rotation of the disk 74 about the shaft 73 is to displace the particles contained in this cavity. This displacement of the particles continues until the instant when this cavity arrives vertically of the openings 85 and 86. At that instant, these particles effectively stop being retained by the plate 63, and they drop into the reservoir 15.

Returning to FIG. 6, it can be seen that the two sealing rings 78 and 79, which form a small spacing of value e between the opposed faces of the disk 74 and the upper plate 62, define an upper annular chute 88 in the zone located between these two faces; the chute 88 has a width substantially equal to (R1−R2) and a height equal to e. Similarly, the two sealing rings 80 and 81, which form a small spacing of value e between the opposed faces of the disk 74 and the lower plate 63, define a lower annular chute 89 in the zone located between these two faces; the chute 88 has a width substantially equal to (R2−R1) and a height equal to e. The discharge conduit 47 discharges into the upper chute 88; the lower plate 63 is provided with an opening 85 which is intended to discharge particles transported by one or the other of the cavities 67A and 67B into the reservoir 15 and discharges into the lower chute 89; and finally, the two chutes 88 and 89 are made to communicate with one another via these two cavities 67A and 67B; because of all these factors, the discharge conduit 47 is connected to the reservoir 15, which is open to the air, as indicated above. The pneumatic negative pressure engendered by the suction turbine 29 inside this conduit 47 thus has the effect of generating an air current that on leaving the reservoir 15 is directed toward the conduit 47, proceeding via the lower chute 89, the cavities 67A and 67B and the upper chute 88. Nevertheless, it should be noted that the value e of the spacing formed by the four sealing rings between the opposed faces of the disk 74 and the upper plate 62, on the one hand, and between the opposed faces of the disk 74 and the lower plate 63, on the other, is always very small, never in fact being greater than one hundred microns. Under these conditions, the air flow that circulates in the two chutes 88 and 89 is always very slight in comparison with the output of the turbine 29 and does not threaten to interfere with the functioning of the negative pressure apparatus 26. In other words, the discharge conduit 47 is quasi-isolated from the ambient atmospheric pressure.

Figure 7A:
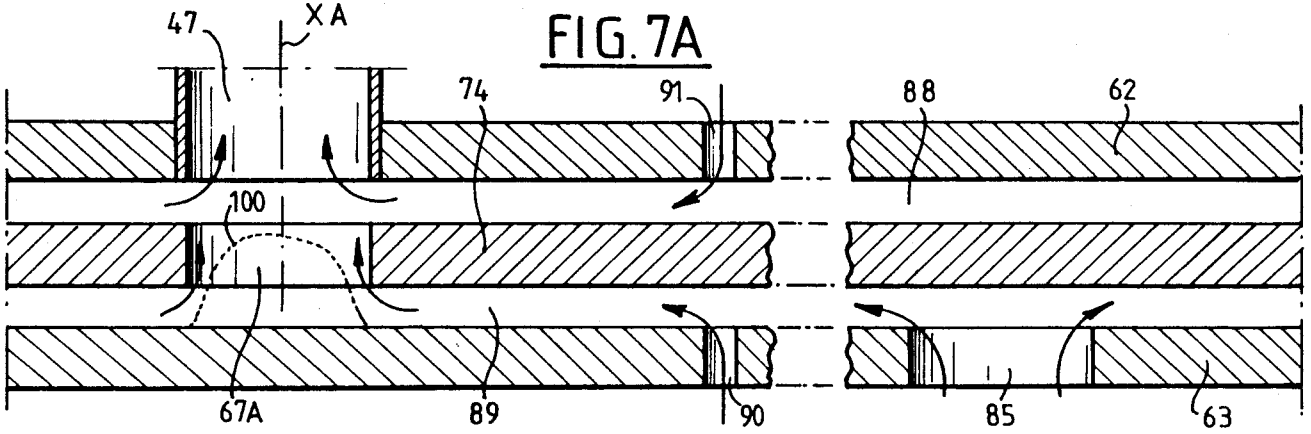
FIG. 7A, 7B and 7C are schematic sectional views that illustrate the roles played by the air flows circulating inside the reintroduction device represented in FIGS. 3 and 4.
Figure 7B:
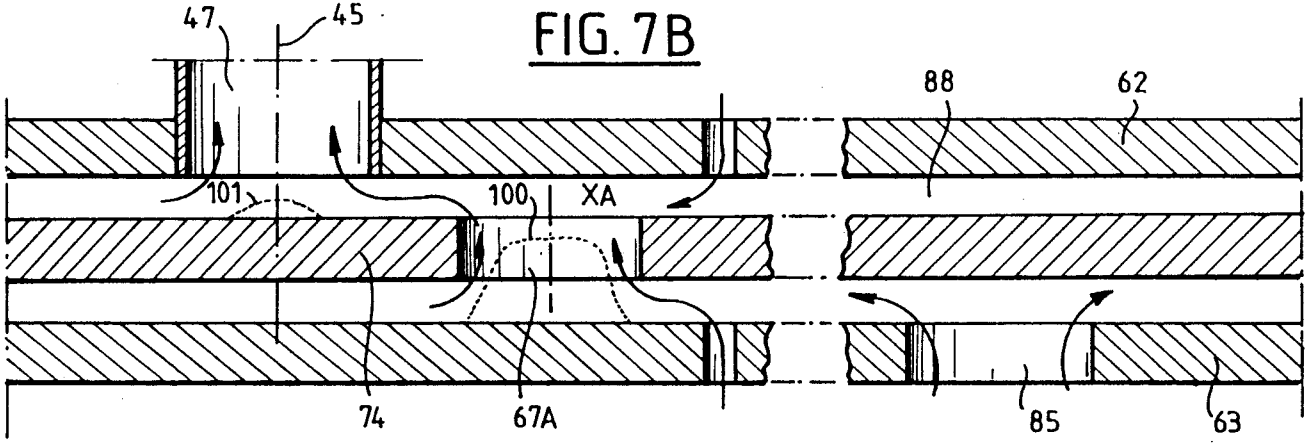
Figure 7C:
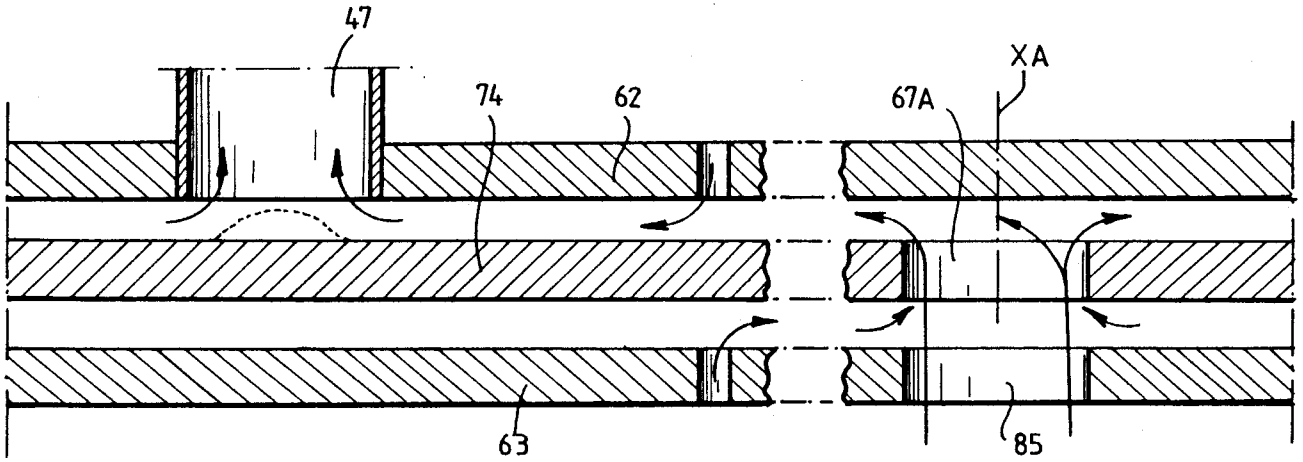

It should also be noted that the air flow that circulates in these two chutes 88 and 89 and passes through the openings 85, 86 and through the cavities 67A and 67B prevents the developer particles that have accumulated in one or the other of the cavities from adhering anywhere except to the cylindrical walls of these cavities. Furthermore, in the course of the displacement of the disk 74, this air flow facilitates the lifting off of the particles that have been applied to the portions of the upper face of the lower plate 63 that serve as the bottom of these cavities. These actions are illustrated by FIGS. 7A, 7B and 7C, which schematically show the direction in which the air flow circulates in the various portions of the chutes 88 and 89 when in the course of the rotation of the disk 74 one of the cavities, e.g. 67A, is displaced from a position in which it is facing the conduit 47 to a position in which it is facing the opening 85. In these three drawing figures, the distances e that separate the disk 74 and the plates 62 and 63, respectively, have been intentionally exaggerated to show more clearly the effects of the air flow. In the position shown in FIG. 7A, the air that circulates in the lower chute 89 comes from outside, and enters the chute after having passed through both the opening 85 and openings 90 made in the lower plate 63. This air escapes from the chute 89, passing through the cavity 67A, and finally is caught in the discharge conduit 47. As can be seen in FIG. 7A, this air, arriving laterally via the base of the cavity 67A, tends to push the particles accumulating in this cavity toward the axis XA of that cavity. Similarly, the air that circulates in the upper chute 88 comes from outside, and enters the chute after having passed through openings 91 made in the upper plate 62. This air escapes via the conduit 47 and forces the particles that drop into that conduit to be spaced apart form the cylindrical wall of the conduit, and to gather around the axis XA of the cavity 67A, which prevents these particles from coming into contact with the cylindrical wall of that cavity. By definition, the particles that accumulate in the cavity 67A finally form a heap 100 of particles, which is kept spaced apart from the cylindrical wall of this cavity by the air that circulates in the chute 89. The effect of the drive of the disk 74 is to space the cavity 67A apart from the lower end of the conduit 47 well before the height of the heap of particles 100 reaches the level of the upper face of this disk. Under these conditions, there is no risk that these particles will adhere to the lower face of the plate 62 when the cavity 67A is driven for displacement, as FIG. 7B shows. It can also be observed from this drawing figure that in the course of the displacement, the air that circulates in the chute 89 and escapes via the cavity 67A forces the particles resting on the fixed plate 63 to move on this plate, while remaining gathered together around the axis XA of the cavity 67A. It can further be noted in this drawing figure that in the course of this displacement, the particles that drop into the conduit 47 accumulate on the upper face of the disk 74, forming another heap of particles 101, and that these particles are urged to move on this face by the action of the air that escapes from the conduit 47 and tends to keep them gathered together around the central axis 45 of that conduit. The displacement of the two heaps of particles 100 and 101 continues until the instant when the cavity 67A arrives facing the opening 85 of the plate 63. At that moment, the particles in the heap 100 are no longer retained by the plate 62, as FIG. 7C shows, and they then pass via the opening 85 to drop into the reservoir 15. It can be noted that all during their transport to the interior of the cavity 67A, the particles of the heap 100 are displaced on the plate 63 while being kept spaced apart from the cylindrical wall of that cavity. Under these conditions the particles do not threaten to undergo the crushing that they would be subjected to if they remained stuck to the upper face of the plate 63 and became wedged between that plate and the disk 74. Moreover, there is no risk that these particles will become lodged in the chutes 88 and 89. However, these results cannot be attained unless the flow of air circulating in the two chutes 88 and 89 is strong enough to compel the particles making up the heaps 100 and 101 to remain gathered together about the axis XA of the cavity 67A and about the central axis 45 of the conduit 4, respectively. Consequently, the spacing e between the opposed faces of the disk 74 and the lower plate 63 and between the opposed faces of the disk 74 and the upper plate 62 must necessarily be at least equal to a predetermined minimum value $e_m$, which is higher, the less the depression $\Delta p$ inside the chamber, and the larger the size of the particles. It has been found experimentally that for a depression $\Delta p$ of approximately 115 hectopascals and for particles having a size on the order of 5 microns, this value em would in practice equal 20 microns. The sealing rings are consequently arranged such that this spacing e is at least equal to this minimum value $e_m$ and at most equal to a maximum value $e_M$ that in practice equals 10 microns, above which the functioning of the negative pressure apparatus 26 is interfered with. In the example described, where the particles have a size of approximately 20 microns, and the depression $\Delta p$ is on the order or two hundred hectopascals, this spacing e is therefore practically equal to 50 microns. Consequently, the reintroduction device described above virtually does not become fouled, and does not interfere with the functioning of the negative pressure apparatus 26.

Thus as FIGS. 4, 5 and 6 show, the two cavities 67A and 67B are located at equal distances fom the sealing rings 78, 79, 80 and 81. In other words, the axes XA and XB of these two cavities are located at a distance from the shaft 73 equal to:

$$\frac{R1 + R2}{2}.$$

Moreover, the radii Rl and R2 of these seals are such that the difference R2−R1 is greater than the diameter D of each of these cavities. Because of this, the portion on the upper face of the plate 62 included between the two seals 78 and 79 may be considered to be made of three portions, that is, a central portion 92 of width D, past which the cavities 67A and 67B travel when the disk 74 rotates, and two annular lateral portions 93 and 94, each having a width equal to:

$$\frac{R2 - R1 - D}{2},$$

these two portions 93 and 94, located on either side of the central portion 92, extending respectively along each of the seals 78 and 79. The openings 91 with which the plate 62 is provided are made such that they discharge precisely at the two annular portions 93 and 94, as FIG. 6 shows. Similarly, on the upper face of the plate 63, the portion included between the two seals 80 and 81 may be considered to be made of three portions, that is, a central portion 95 of width D, past which the cavities 67A and 67B travel when the disk 74 rotates, and two annular lateral portions 96 and 97, each having a width equal to:

$$\frac{R2 - R1 - D}{2},$$

these two portions 96 and 97, located on either side of the central portion 95, extending respectively along each of the seals 80 and 81. The openings 90 with which the plate 63 is provided are made such that they discharge precisely at the two annular portions 96 and 97. Since in the course of the rotation of the disk 74 the particles accumulated in one of the cavities 67A and 67B are urged to be displaced on the upper face of the palte 63, while remaining vertically of that cavity, and hence are displaced only over the central portion 96 of this face and do not threaten to obstruct the openings 90 of the plate.

It should be pointed out again that the openings 90 and 91 of the plates 62 and 63 are relatively small in diameter, to minimize the admission of dust in the ambient air through these openings, which in the long term would stop them up. This outcome was attainable by making the openings such that each one has a diameter equal to no more than one millimeter. The admission of dust can also be prevented by stopping the dust with filters.

It can be noted that in the embodiment shown in FIG. 4, the disk 74 is provided with two cavities 67A and 67B disposed symmetrically with respect to the pivot shaft 73. As a result, the transport of particles collected by the discharge conduit 47 into the reservoir 15 can be accomplished by making the disk 74 rotate continuously at a speed equal to one-half that which would be necessary if the disk, rotating continuously, were provided with only one cavity. On this point, it is useful to point out that in the example described, where the disk 74 includes two cavities, it is driven in rotation continuously at a speed on the order of 5 revolutions per minute, so that a relatively low-power and hence inexpensive motor 77 can be used to drive the disk. Nevertheless, it should be noted that in the case where the volume of particles to be transported in a given period would be greater than that transported during the same period by the two cavities of the disk of the apparatus described above, then it would be possible, without modifying the speed of rotation of the disk, to assure the transport of the particles by providing a number of cavities in the disk greater than two, this number being determined as a function of the volume of particles to be transported during this time.

It is understood that the invention is in no way limited to the embodiments described and illustrated, which are given solely by way of example. On the contrary, the invention includes any means comprising technical equivalents of those described and shown, taken in isolation or in combination and embodied within the scope defined by the following claims.

What is claimed is:

1. A device for reintroducing solid developer particles that have been separated from a gaseous carrier flow with the aid of a negative pressure separator apparatus (26), into a reservoir (15) open to the air, the negative pressure apparatus including a separation chamber (40) provided with a discharge conduit (47) in its lower portion, comprising:

a chute (61) disposed in front of and below said discharge conduit (47), and having an opening enabling said conduit to discharge into this chute;

a transport element (65) arranged to slide on the inside of said chute while effecting quasi-isolation of the discharge conduit with respect to the ambient atmospheric pressure, said transport element having at least one cavity (67), which, when said element is put in a position of repose, is located facing the lower end (64) of said discharge conduit and enables the developer particles that drop into the conduit to accumulate in the cavity;

and a drive means (66G, 66D or 76, 77) arranged to drive said transport element (65) along a predetermined path enabling said cavity (67) to be put in an evacuation location (Pl), above the reservoir, in order to allow the particles that have accumulated in the cavity to drop into the reservoir, and then to move this transport element into a position of repose.

2. The device for the reintroduction of particles as defined by claim 1, characterized in that the transport element (65) comprises a belt of material impermeable to air, the belt being configured so as to slide inside the chute (61) with play reduced as much as possible.

3. The device for the reintroduction of particles as defined by claim 1, characterized in that the chute (61) includes a first plate (63) and a second plate (62) disposed horizontally, one above the other, above the particle reservoir (15), said second plate (62) being mounted in fixed fashion at the level of the lower end (64) of the discharge conduit, said first plate (63) being mounted in such a manner as to be capable of vertical displacement under said second plate (62), said first plate (63) being urged toward said second plate (62) by elastic means (82).

4. The device for the reintroduction of particles as defined by claim 3, characterized in that the transport element comprises a rigid disk (74) disposed between said first and second plates (63 and 62) and mounted so as to be capable of rotation about a vertical shaft (73) passing through the two plates.

5. The device for the reintroduction of particles as defined by claim 4, characterized in that the rigid disk (74) is provided with two elastic sealing rings (78, 80) having a radius equal to a first value (Rl) and two elastic sealing rings (79, 81) having a radius equal to a second value (R2) greater than said first value, said four seals being mounted in such a manner that two of said seals (78 and 79), having different radii, are concentrically disposed about the pivot shaft (73) of the disk, on one of the faces of said disk, and the other two seals (80 and 81) are disposed concentrically about said shaft (73) on the other face of the disk, each of the four seals protruding from the face of the disk on which it is placed.

6. The device for the reintroduction of particles as defined by claim 5, characterized in that given that the cavity (67) is a straight cylinder having a circular base of diameter D, the values (RI and R2) of the radii of the sealing rings (78, 79, 80 and 81) are such that the difference R2−Rl between these values is greater than said diameter D.

7. The device for the reintroduction of particles as defined by claim 6, characterized in that the sealing rings (78, 79, 80 and 81) of the disk (74) are arranged, when the disk is urged to press against the second plate (62) in response to the thrust exerted by the first plate (63), so as to leave, between the opposed faces of said disk and said second plate, on the one hand, and between the opposed faces of said disk and said first plate, on the other, a spacing (e) the value of which equals no more than 100 microns.

8. The device for the reintroduction of particles as defined by claim 7, characterized in that given that upon the rotation of the disk (74) the cavity (67) passes vertically of an annular portion (95) belonging to the upper face of the first plate (63), this first plate is pierced with openings (90) that discharge at this upper face between the two seals (80 and 81) that are pressed against this face, but outside said annular portion (95).

9. The device for the reintroduction of particles as defined by claim 8, characterized in that given that upon the rotation of the disk (74) the cavity (67) passes vertically of another annular portion (92) belonging to the lower face of the second plate (62), the second plate being pierced with openings (90) that discharge at the lower face between the two seals (78 and 79) that are pressed against the lower face, but outside said annular portion (92).

10. The device for the reintroduction of particles as defined by claim 9, characterized in that the disk (74) is driven in continuous rotation at a speed equal at most to 1/5 revolution per second.

11. The device for the reintroduction of particles as defined by claim 8, characterized in that the disk (74) is driven in continuous rotation at a speed equal at most to 1/5 revolution per second.

12. The device for the reintroduction of particles as defined by claim 7, characterized in that given that upon the rotation of the disk (74) the cavity (67) passes vertically of another annular portion (92) belonging to the lower face of the second plate (62), the second plate being pierced with openings (90) that discharge at the lower face between the two seals (78 and 79) that are pressed against the lower face, but outside said annular portion (92).

13. The device for the reintroduction of particles as defined by claim 12, characterized in that the disk (74) is driven in continuous rotation at a speed equal at most to 1/5 revolution per second.

14. The device for the reintroduction of particles as defined by claim 7, characterized in that the disk (74) is driven in continuous rotation at a speed equal at most to 1/5 revolution per second.

15. The device for the reintroduction of particles as defined by claim 6, characterized in that the disk (74) is driven in continuous rotation at a speed equal at most to 1/5 revolution per second.

16. The device for the reintroduction of particles as defined by claim 5, characterized in that the disk (74) is driven in continuous rotation at a speed equal at most to 1/5 revolution per second.

17. The device for the reintroduction of particles as defined by claim 4, characterized in that the disk (74) is driven in continuous rotation at a speed equal at most to 1/5 revolution per second.

18. A non-impact printing machine, characterized in that it includes a means for the reintroduction of particles as defined by claim 1.

19. A non-impact printing machine, characterized in that it includes a means for the reintroduction of particles as defined by claim 2.

20. A non-impact printing machine, characterized in that it includes a means for the reintroduction of particles as defined by claim 3.

21. A non-impact printing machine, characterized in that it includes a means for the reintroduction of particles as defined by claim 4.

22. A non-impact printing machine, characterized in that it includes a means for the reintroduction of particles as defined by claim 5.

23. A non-impact printing machine, characterized in that it includes a means for the reintroduction of particles as defined by claim 6.

24. A non-impact printing machine, characterized in that it includes a means for the reintroduction of particles as defined by claim 7.

25. A non-impact printing machine, characterized in that it includes a means for the- reintroduction of particles as defined by claim 8.

26. A non-impact printing machine, characterized in that it includes a means for the reintroduction of particles as defined by claim 12.

27. A non-impact printing machine, characterized in that it includes a means for the reintroduction of particles as defined by claim 9.

28. A non-impact printing machine, characterized in that it includes a means for the reintroduction of particles as defined by claim 17.

* * * * *

UNITED STATES PATENT AND TRADEMARK OFFICE

CERTIFICATE OF CORRECTION

PATENT NO. : 4,972,203

DATED : November 20, 1990

INVENTOR(S) : Andre Brecy, et al

It is certified that error appears in the above-identified patent and that said Letters Patent is hereby corrected as shown below:

Col. 14, line 66 (claim 13); "claim 12" should be --claim 10--.

Col. 16, line 18, (claim 26); "claim 12" should be --claim 10--.

Col. 16, line 24, (claim 28); "claim 17" should be --claim 11--.

Signed and Sealed this

Sixth Day of October, 1992

*Attest:*

DOUGLAS B. COMER

*Attesting Officer*

*Acting Commissioner of Patents and Trademarks*